US010829890B2

(12) United States Patent
Eklind et al.

(10) Patent No.: US 10,829,890 B2
(45) Date of Patent: Nov. 10, 2020

(54) SYSTEM AND METHOD FOR IN-LINE TREATMENT OF THREAD FOR USE WITH A THREAD CONSUMPTION DEVICE

(71) Applicant: Coloreel Group AB, Jönköping (SE)

(72) Inventors: Martin Eklind, Jönköping (SE); Joakim Staberg, Jönköping (SE)

(73) Assignee: Coloreel Group AB, Jönköping (SE)

( * ) Notice: Subject to any disclaimer, the term of this patent is extended or adjusted under 35 U.S.C. 154(b) by 10 days.

(21) Appl. No.: 16/082,635

(22) PCT Filed: Mar. 7, 2017

(86) PCT No.: PCT/SE2017/050207
§ 371 (c)(1),
(2) Date: Sep. 6, 2018

(87) PCT Pub. No.: WO2017/155451
PCT Pub. Date: Sep. 14, 2017

(65) Prior Publication Data

US 2019/0100873 A1 Apr. 4, 2019

(30) Foreign Application Priority Data

Mar. 7, 2016 (SE) ..... 1650301

(51) Int. Cl.
*D06B 11/00* (2006.01)
*D06P 5/30* (2006.01)
(Continued)

(52) U.S. Cl.
CPC ..... *D06P 5/30* (2013.01); *D03J 1/04* (2013.01); *D04B 35/22* (2013.01); *D05B 67/00* (2013.01);
(Continued)

(58) Field of Classification Search
None
See application file for complete search history.

(56) References Cited

U.S. PATENT DOCUMENTS 4,100,724 A * 7/1978 Bous ..... D06B 11/0023 239/574
5,624,494 A 4/1997 Schmolke et al.
(Continued)

FOREIGN PATENT DOCUMENTS

CL 2018002535 A1 12/2018
CN 2490176 5/2002
(Continued)

OTHER PUBLICATIONS

International Search Report issued in corresponding PCT Application No. PCT/SE2017/050207, dated Apr. 26, 2017, pp. 1-4.

*Primary Examiner* — Cachet I Proctor
(74) *Attorney, Agent, or Firm* — Murtha Cullina LLP

(57) ABSTRACT

A system for in-line treatment of thread for use with a thread consuming device is provided. The system includes a treatment unit having a plurality of nozzles arranged at different positions relative the thread, said thread being in motion in use, each nozzle being configured to dispense one or more coating substances onto the thread when activated; and a control unit configured to activate at least two of the nozzles to dispense the coating substance at different circumferential positions of the thread when the thread twists along its longitudinal axis.

19 Claims, 4 Drawing Sheets

(51) Int. Cl.

| | |
|---|---|
| ***D05B 67/00*** | (2006.01) |
| ***D05C 11/24*** | (2006.01) |
| ***D03J 1/04*** | (2006.01) |
| ***D04B 35/22*** | (2006.01) |
| *B41J 3/407* | (2006.01) |

(52) U.S. Cl.
CPC ..... *D05C 11/24* (2013.01); *D06B 11/0003* (2013.01); *D06B 11/0023* (2013.01); *D06B 11/0036* (2013.01); *B41J 3/407* (2013.01)

(56) References Cited

U.S. PATENT DOCUMENTS 6,189,989 B1 * 2/2001 Hirabayashi ..... B41J 3/407 347/106
2003/0135931 A1 * 7/2003 Shaw ..... D06B 11/0023 8/115.6
2009/0241819 A1 * 10/2009 Tseng ..... B41J 3/4078 112/470.05
2014/0349034 A1 * 11/2014 Staberg ..... D05C 11/24 427/580
2014/0349035 A1 * 11/2014 Cho ..... B44C 1/227 428/31

FOREIGN PATENT DOCUMENTS

| | | | | |
|---|---|---|---|---|
| CN | 201439265 U | * | 4/2010 | |
| EA | 201891920 A1 | | 4/2019 | |
| EP | 1548757 A1 | * | 6/2005 | ..... H01B 13/345 |
| JP | 2003342867 | | 12/2003 | |
| JP | 2003342867 A | * | 12/2003 | |
| KR | 100985471 B1 | | 10/2010 | |
| WO | 0012804 | | 3/2000 | |
| WO | 02063094 A1 | | 8/2002 | |
| WO | 2017155451 A1 | | 9/2017 | |

* cited by examiner

SYSTEM AND METHOD FOR IN-LINE TREATMENT OF THREAD FOR USE WITH A THREAD CONSUMPTION DEVICE

TECHNICAL FIELD

The present invention pertains to a system, method, and device for in-line treatment of thread for use with a thread consumption device.

BACKGROUND

Existing in-line treatment devices may be used for coating a thread passing there through.

However, an improved way of controlling the coating process would be advantageous.

SUMMARY

An object of the present invention is therefore to provide an improved system for controlling the coating process.

According to a first aspect, a system for in-line treatment of thread for use with a thread consuming device is provided. The system includes a treatment unit having a plurality of nozzles arranged at different positions relative the thread, said thread being in motion in use. Each nozzle is configured to dispense one or more coating substances onto the thread when activated; and the system further includes a control unit configured to activate at least two of the nozzles to dispense the coating substance at different circumferential positions of the thread when the thread twists along its longitudinal axis.

In an embodiment, the control unit is configured to calculate a required longitudinal distance between the nozzles to be activated for allowing dispensing the coating substance on specific circumferential positions of the thread, and identify the nozzles of the treatment unit to be activated based on the known longitudinal distance between the nozzles and the required longitudinal distance.

The control unit may be configured to set a longitudinal distance between the nozzles to be activated, wherein the longitudinal distance is set by longitudinally moving at least one of the nozzles such that said at least one nozzle can dispense the coating substance on a desired unique circumferential position of the thread.

In an embodiment the control unit is configured to set a longitudinal distance between a first position at which a dispensed droplet from a first nozzle is assumed to hit the thread and a second position at which a subsequently dispensed droplet from a second nozzle is assumed to hit the thread, and wherein the system further includes means for changing the travel path of dispensed droplets in accordance with the longitudinal distance.

The control unit may be configured to calculate the longitudinal distance based on the twist of the thread.

The control unit is in some embodiments configured to set an activation timing of the nozzles such that each nozzle can dispense the coating substance on a unique circumferential position of the thread.

The nozzles may be arranged in a common plane.

The control unit may be configured to set the activation timing of the at least two nozzles based on the thread speed ($v$ [m/s]). The control unit may be configured to set the longitudinal distance based on a forward feeding speed ($v$ [m/s]) of the thread in conjunction with the twist of the thread or on a set activation timing of the nozzles.

In an embodiment, the control unit is further configured to set the longitudinal distance based on the twist per length unit ($\omega$ [rad/m]) of the thread in accordance with $20\pi/\omega \geq d2, d3, d4 > 0$.

The at least two nozzles to be activated may be provided on a common nozzle array. The nozzles may be inkjet nozzles, and the coating substance may be a coloring substance.

In an embodiment the treatment unit includes multiple nozzle arrays, and a specific nozzle array may be assigned with a specific coating substance.

One or more nozzle arrays may be arranged in a common nozzle head.

The control unit may further be configured to set the longitudinal distance based on the level of wetting of the thread.

The control unit may be configured to set the longitudinal distance based on a pre-set coating effect.

Said pre-set coating effect may be selected from the group comprising homogeneous coloring pattern, one-side-only coloring pattern, random coloring pattern, or helical coloring pattern.

According to a second aspect, a thread consuming device is provided. The device includes a thread consuming unit and a system according to the first aspect.

The thread consuming unit may be an embroidery unit, a sewing unit, a knitting unit, or a weaving unit.

According to a third aspect, a method for in-line treatment of thread is provided. The method includes providing a treatment unit having a plurality of nozzles arranged at different longitudinal positions along the thread, each nozzle being configured to dispense a coating substance onto the thread when activated; and providing a control unit configured to activate at least two of the nozzles to dispense the coating substance at different circumferential positions of the thread when the thread twists along its longitudinal axis.

BRIEF DESCRIPTION OF THE DRAWINGS

Embodiments of the invention will be described in the following description of the present invention; reference being made to the appended drawings which illustrate non-limiting examples of how the inventive concept can be reduced into practice.

DETAILED DESCRIPTION

An idea of the present invention is to provide a system, device, and method for distributing a coating substance onto a thread in a controlled manner, for use in association with a thread consumption device. The thread consumption device may be an embroidery machine, weaving machine, sewing machine or knitting machine, or any other thread consumption device which may benefit from a surface treatment or coating or any other process involving subjecting the thread to a liquid substance, such as dying. More particularly, an object is to allow for a precise dispensing onto the thread at defined circumferential positions around the thread which is advantageous as such precise dispensing will allow for a very accurate positioning of the coating substance onto the thread. For example, it will be possible to obtain specific coloring patterns onto the thread.

Figure 1:
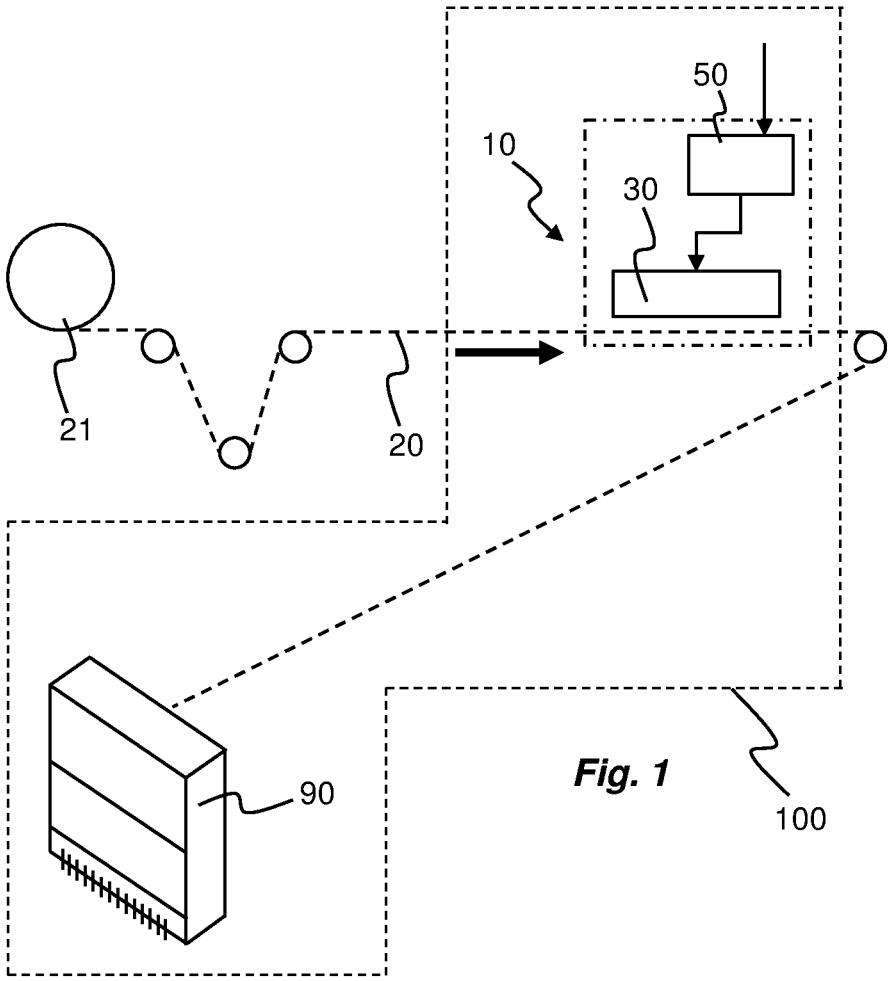
FIG. 1 shows a schematic view of a thread consuming device according to an embodiment.

A system 10 for in-line treatment of thread 20 for use with a thread consumption device 100, including a thread consumption unit 90 such as an embroidery machine, is schematically shown in FIG. 1. The term "thread" should in this context be interpreted broadly to include any elongate substrate; a wire and a filament are for example all threads in the present context. The thread 20 is fed from a thread supply 21, passes through the system 10 for in-line treatment of the thread 20, and is fed to the thread consumption unit 90.

Figure 2:
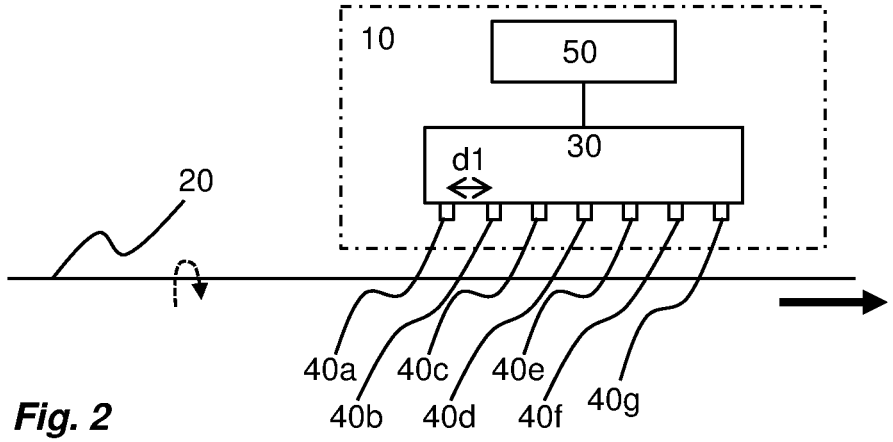
FIG. 2 shows a schematic view of a system according to an embodiment.

Now turning to FIG. 2 the system 10 comprises a treatment unit 30 having a plurality of nozzles 40*a-g* arranged at different longitudinal positions along the thread 20 which passes by the treatment unit 30 during use. The direction of movement of the thread in use is indicated by the solid arrow in FIG. 2. Each nozzle 40*a-g* is arranged to dispense a coating substance, such as ink, onto the thread 20 when the nozzle is activated. The system 10 further comprises a control unit 50 arranged to activate at least two of the nozzles 40*a-g* to dispense the coating substance such that the coating substance is absorbed by the thread 20 at different circumferential positions of the thread 20 when the thread 20 twists about its longitudinal axis. The relative position of two adjacently dispensed droplets of coating substance may be selected such that the droplets will overlap. The twisting of thread 20 is illustrated by the curved dashed arrow in FIG. 2.

For a coloring operation the control unit 50 receives one or more input signals specifying the desired color and/or coloring effect. The color input preferably includes information regarding the exact color, as well as the longitudinal start and stop positions of the thread 20 for that particular color. The longitudinal start and stop position could be represented by specific times if the thread speed is determined.

The coloring effect input preferably includes pattern information, e.g. if an even coloring is desired. Normally, a homogenous coloring would require coating on different circumferential positions in a close longitudinal range of the thread. On the other hand, a one-sided coloring effect would require coating on a single circumferential position only.

Based on the knowledge that the thread 20 has a certain twist per length unit it is possible to precisely dispense the coating substance at different circumferential positions of the thread 20 as the thread 20 passes by the treatment unit 30. By multiplying the twist per length unit with the speed of the thread 20 it is possible to obtain the twist rate, i.e. the twist angle per second. For example, if the twist per length unit is 360°/cm and the speed of the thread 20 is 2 cm/s, the resulting twist rate is 720°/s, i.e. two 360° revolutions per second. The twist rate may be used to calculate an activation timing required for each nozzle 40*a-g* such that each nozzle 40*a-g* can dispense the coating substance such that the coating substance will hit the thread 20 on a unique circumferential position of the thread 20.

It should be appreciated that the twist of the thread 20 relates to a rotation of the thread 20 seen by an observer as the thread is moving in a longitudinal direction. Optionally the thread may have a native twist, e.g. formed by the helical appearance of a multi filament thread. When the helically arranged strands pass a fix longitudinal position it will appear as if the thread rotates with reference to the fix longitudinal position. In another embodiment, if the thread comprises only one filament or filaments arranged in parallel along the longitudinal extension thereof, a twist may be induced by forcing a relative rotation between two ends of the thread, e.g. by rotating one end of the thread in relation to the other, thereby resulting in a twist of the thread at the treatment unit 30.

Additionally or alternatively, it is also possible to achieve a twist of the thread e.g. by using members engaging with the thread as it passes the treatment unit 30. When the engagement member is provided in the downstream direction of movement, the twist is achieved upstream of the engagement member. Such a twist may be called false twist since the thread tends to return to its initial twist state downstream of the engagement member.

The way the twist is provided to the thread 20 is of less importance for the present invention to be carried out. Instead an important factor is that the twist of the thread 20, and in particular the twist of the thread 20 when it passes the treatment unit 30, is known in order to be able to control the activation of the nozzles 40*a-g* of the treatment unit 30 such as to controllably dispensing coating substance at unique circumferential positions of the thread 20 in use. The twist could either be plastic, i.e. the twist is more or less constant, or elastic, i.e. the twist changes while the thread 20 passes through the treatment unit 30.

Moreover, the activation timing is also based on the knowledge of the longitudinal distance d1 between each of the plurality of nozzles 40*a-g*. For example, it is possible to dispense a coating substance onto a thread 20 at the same longitudinal position and at two chosen circumferential positions, such as 0° and 180°, by knowing the longitudinal distance d1 between the respective nozzles 40*a-g*. For example, if the longitudinal distance between a first and a second nozzle 40*a-g* is 5 mm, giving the example above, it will take 0.25 seconds (5 mm/(2 cm/s)) for a specific position of the thread 20 to move from the first nozzle 40*a-g* to the second nozzle 40*a-g*. In 0.25 seconds the thread 20 has twisted 180° (720°/s*0.25 s). Hence, in this case the activation timing may be calculated such that the first nozzle is activated at time zero, and the second nozzle is activated 0.25 seconds after time zero.

The control unit 50 has processing capabilities and may comprise a processor with memory. The control unit 50 may receive input relating to a twist level parameter associated with the level of twist, e.g. twist angle per length unit of the thread 20 and a speed level parameter associated with the speed of the thread 20 passing through the treatment unit 30 in use. The input may be received via another device, e.g. a sensor, graphical user interface (not shown). Alternatively the input may be hard coded into the control unit 50.

The control unit 50 may be further arranged to transmit a control signal to the treatment unit 30. The control signal sent by the control unit to the treatment unit 30 may be an activation signal for activating the nozzles 40*a-g* of the treatment unit 30 according to a dispensing timing scheme selected based on the received twist level parameter and speed level parameter. Hence, the control unit 50 may be arranged to process the twist level parameter and the speed level parameter and determining the dispensing timing scheme.

Alternatively, the control signal sent to the treatment unit 30 may comprise information about the twist level parameter and the speed level parameter. The treatment unit 30 receives the control signal from the control unit 50 and dispenses a coating substance to the thread 20 via two or more of the nozzles 40*a-g* according to a dispensing timing scheme selected based on the received twist level parameter and speed level parameter.

Although seven nozzles 40*a-g* are shown in FIG. 2, the treatment unit 30 need only comprise at least two nozzles such as nozzles 40*a* and 40*b*. However, e.g. a typical inkjet head, which is a suitable component for realizing the invention, comprises hundreds or even thousands of nozzles. Other dispensing technologies may also be used.

Figure 3:
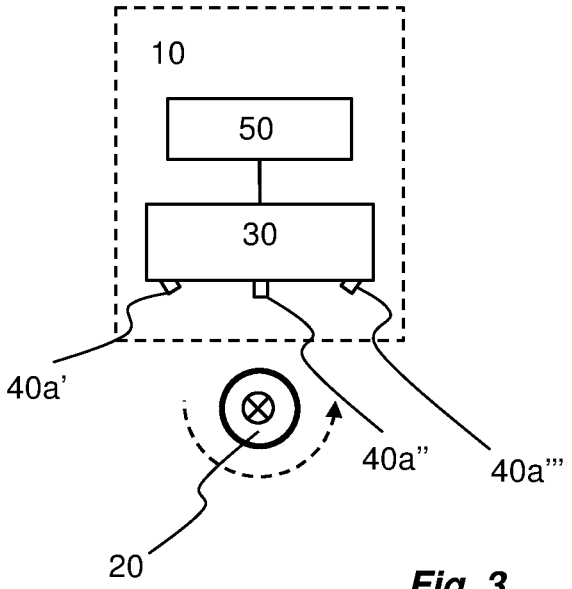
FIG. 3 shows a front view of a system according to an alternate embodiment.

FIG. 3 illustrates a variation of the system 10 in FIG. 2. In system 10 in FIG. 3 the nozzles 40*a*', 40*a*", 40*a*'" are arranged at different radial positions around the thread 20. The nozzles 40*a*', 40*a*", 40*a*'" may be arranged at a specific longitudinal position, or they may be distributed along the longitudinal direction. While FIG. 2 is a front view of the system 10, FIG. 3 is a side view of the system 10 and the twist of the thread 20 that occurs as the thread 20 moves past the system 10 is shown by the semi-circular dashed arrow. The thread 20 is assumed to move in the direction of the arrow symbol provided in the centre of the thread 20. The system 10 in FIG. 3 also has a treatment unit 30 and a control unit 50 which operate in the same manner as described above in relation to FIGS. 1 and 2. However, the treatment unit 30 and the control unit 50 shown in FIG. 3 are configured to allow for simultaneous activation of the nozzles 40*a*', 40*a*", 40*a*'".

Figure 4:
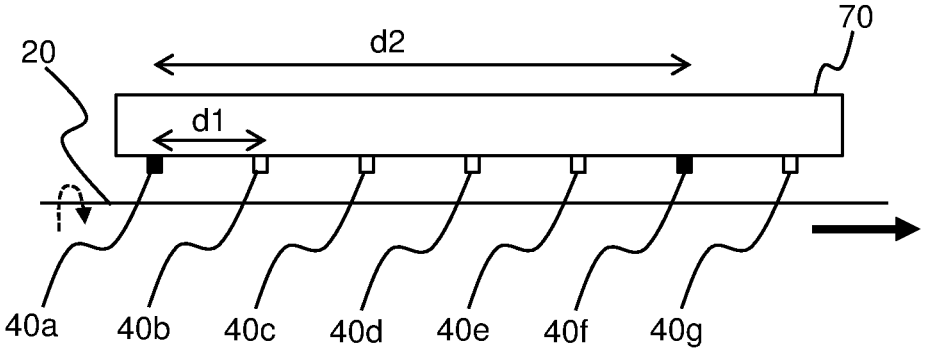
FIG. 4 shows a treatment unit according to an embodiment.

The plurality of nozzles 40*a-g* may be arranged in a static nozzle array 70, e.g. further shown in FIG. 4. Here, the position of the nozzles 40-*g* and other nozzles (not shown) are fixed on the treatment unit 30. The nozzles 40*a-g* are longitudinally separated by a fix distance d1. Recapturing the example above, if the intention is to dispense coating substance onto the thread at the same longitudinal position thereof at 0° and at 180° it would be possible to calculate a required longitudinal distance d2 by the following formula: (180°)/(twist per length unit), wherein the twist per length unit is (360°/cm) from the example above. Hence, the required longitudinal distance d2 to achieve the required dispensing is 0.5 cm. It should be appreciated that the fix distance d1 between two adjacent nozzles 40*a-g* may be very small such as below 0.05 mm. The control unit 50 may be arranged to identify which nozzles 40*a-g* to activate, based on the calculated required longitudinal distance d2. For example, when the fix distance d1 is 1 mm and the required longitudinal distance d2 is 0.5 cm, i.e. 5 mm, the first nozzle and the sixth nozzle may be identified for activation, since the sixth nozzle is located 5 mm away from the first nozzle. FIG. 4 shows this wherein the first 40*a* and sixth nozzle 40*f* has been indicated.

Accordingly, the control unit 50 may activate the nozzles 40*a-g* to dispense a coating substance on a unique circumferential position of the thread 20. A required longitudinal distance d2 may still be calculated by the control unit 50 to identify a suitable nozzle pair, where a second nozzle of the nozzle pair is located at, or as close as possible to, the required longitudinal distance d2 measured from a first nozzle of the nozzle pair. The activation of any required nozzle 40*a-g* may be made using the activation signal and being based on the twist level parameter discussed above, and/or based on the desired result.

The examples above illustrate the possibility of dispensing at two specific circumferential positions, optionally at the same longitudinal position of the thread 20. However, normally it may not be necessary to dispense coating substance at the same longitudinal position of the thread 20 from different circumferential positions. Instead, in some embodiments it is more preferred to dispense the coating substance at regular longitudinal intervals along the thread 20 but from different circumferential positions. However, for colors requiring a high saturation level it may be desired to dispense several droplets at the same longitudinal position.

By being able to controllably dispensing the coating substance at different circumferential positions of the thread 20 it is possible to provide the thread 20 with novel coating features, such as solid color, gradients, shades, simulated reflections, helical coloring pattern etc.

The length of the nozzle array may preferably be at least as long as the distance it takes for the thread 20 to rotate one 180° revolution around itself, and more preferably at least as long as the distance it takes for the thread 20 to rotate a 360° revolution around itself.

However, it should be noted that in some embodiments it may be advantageous to allow the thread 20 to rotate more than one revolution between the longitudinal ends of the nozzle array 70, i.e. between the first and last nozzle of the array 70. This could be particularly advantageous when more than two nozzles 40*a-g* are arranged in the treatment unit 30. By providing an induced level of twist to make the thread 20 rotate several revolutions between the first nozzle 40*a* and the last nozzle 40*g* an even coating that evenly covers the outer surface of the thread 20 may be achieved by activating suitable nozzles arranged in between the first and the last nozzle. Other coloring effects may of course also be utilized. As the twist of the thread 20 is taken into account when determining the dispensing scheme, it is possible to control the resulting coating (or coloring) effect in a very accurate manner. This is due to the fact that as the thread 20 twist at some point every circumferential position will be aligned with a nozzle 40*a-g*.

Accordingly, a higher twist rate results in more twist per length unit of the thread 20, thus allowing for a more even and better coverage of the coating substance around the outer surface of the thread 20 as the nozzles to be activated may be chosen, or controlled, in accordance with a larger number of controlling schemes. Further to this, it will also be possible to reduce the entire length of the nozzle array 70 thus allowing for a more compact design of the system 10.

How the thread 20 is coated around its circumference will depend on the droplet size. A small droplet size will result in a less coating coverage, which means that it may be required to dispense an increased number of droplets on the same longitudinal position of the thread 20 in order to obtain a full coverage around the circumference of the thread 20.

In an embodiment, the control unit is configured to set the longitudinal distance d2 between the at least two activated nozzles 40*a-g* based on the twist per length unit ω [rad/m] of the thread (20), in accordance with $20\pi/\omega \geq d2 > 0$.

This means that the calculated required longitudinal distance d2 is set to allow the thread to twist up to 10 revolutions between the two associated nozzles.

In some embodiments the control unit 50 is further configured to set the longitudinal distance d2 between the nozzles to be activated based on the level of wetting of the thread.

In alternative embodiments the control unit 50 is further configured to set the longitudinal distance d2 between the nozzles to be activated based on a pre-set coloring effect. The pre-set coloring effect may be selected from the group comprising homogeneous coloring pattern, one-side-only coloring pattern, random coloring pattern, or helical coloring pattern.

Further Embodiments

Figure 5:
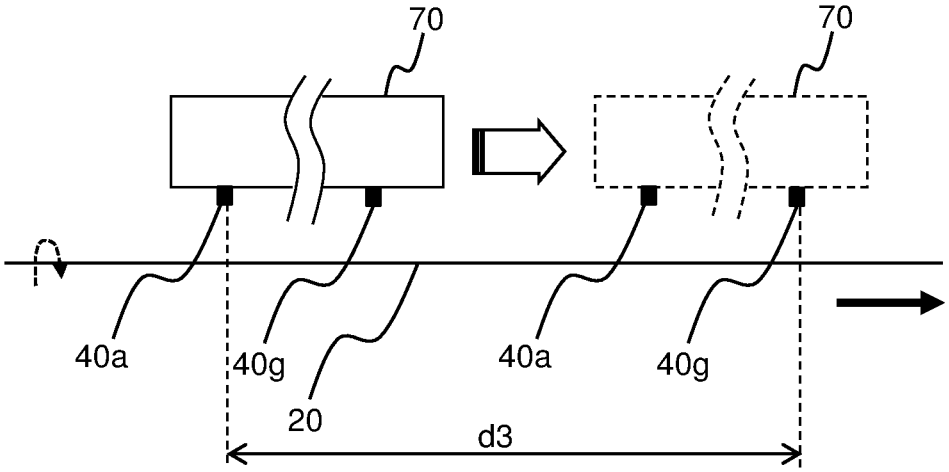
FIG. 5 shows a treatment unit according to an embodiment.

In a further embodiment, the treatment unit 30 comprises nozzles 40*a-g*, which may be separated by a longitudinal distance d3 that may be increased or decreased. Such embodiment is shown in FIG. 5. Now considering a situation where a first droplet is dispensed from a first nozzle 40*a*, and a subsequent droplet is dispensed from a second nozzle 40*g*. The longitudinal position of the secondly activated nozzle 40*g* may be adjusted, either by moving the secondly activated nozzle 40*g* relative the firstly activated nozzle 40*a*, or, as is shown in FIG. 5, by moving the entire nozzle array 70 after the first nozzle 40*a* has been activated, but before the activation of the second nozzle 40*g*.

Figure 6:
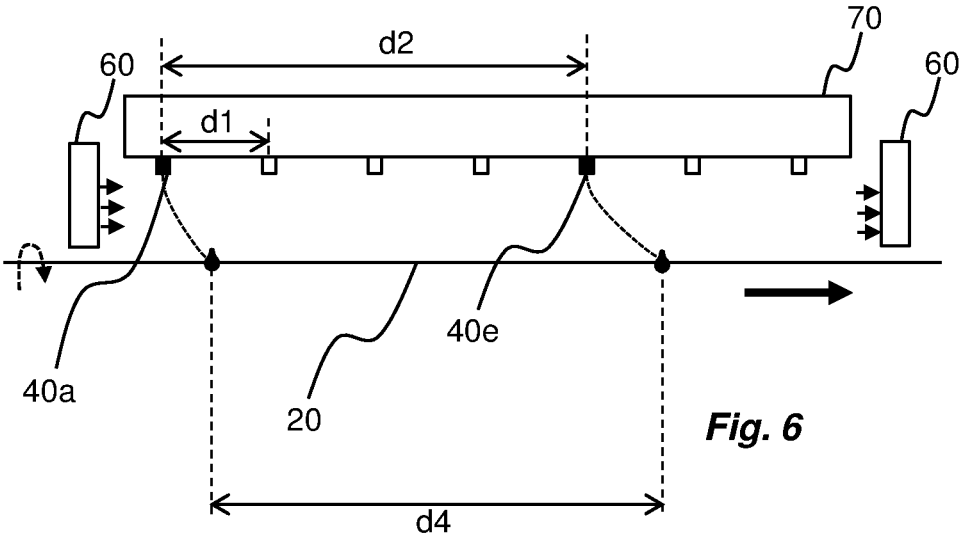
FIG. 6 shows a treatment unit according to an embodiment.

In another embodiment, the dispensed droplets could be diverted before they hit the thread 20 e.g. by applying an electromagnetic field. In such embodiment the control unit 50 is configured to set a longitudinal distance d4 between a first position at which a dispensed droplet from a first nozzle 40*a* is assumed to hit the thread 20 and a second position at which a subsequently dispensed droplet from a second nozzle 40*e* is assumed to hit the thread 20, and wherein the system 10 further comprises means 60 for changing the travel path of dispensed droplets in accordance with the longitudinal distance d4. This is shown in FIG. 6.

This makes it possible to arrange the nozzles 40*a-g* at different positions along the longitudinal extension or direction of the thread 20 depending on a desired dispensing scheme. This is particularly advantageous when the calculated required longitudinal distance d4 for a certain desired dispensing scheme differs from what is physically possible, e.g. compared to what is obtained by calculating the longitudinal distance d2, d3 between the nozzles 40*a-g*. Should the distance d2, d3 differ from the required longitudinal distance, it would be possible to adjust the resulting dispensing scheme by diverting the droplets such that the resulting longitudinal distance d4 is matched with the desired longitudinal distance.

For the embodiment described above utilizing a separation between nozzles 40*a-g*, at least one of the nozzles 40*a-g* is connected to a means, e.g. a motor (not illustrated), capable of adjusting the relative longitudinal distance d3 between the nozzles along and/or around the thread, or by changing the thread twist. The motor may receive input from the control unit 50. Depending on the twist of the thread 20, in conjunction with the speed thereof, the relative position between the nozzles 40*a-g* may be adjusted according to the associated dispensing scheme. Hence, the higher the level of twist as indicated by the twist level parameter of the thread 20, the closer the at least two nozzles 40*a-g* may be positioned to each other i.e. the longitudinal distance d3 may be decreased. Analogously, a lower level of twist as indicated by the twist level parameter is translated to a larger relative distance between the nozzles 40*a-g* i.e. the longitudinal distance d3 is increased. Hence, by adjusting the longitudinal distance d3 between the at least two nozzles 40*a-g* it is possible to improve the coating quality of the thread 20, such that the coating substance is dispensed around the outer perimeter of the thread in a controlled manner.

It should be noted that for a thread treatment unit 30 comprising more than two nozzles 40*a-g*, a motor may be connected to each additional nozzle such as to allow for adjustment of the longitudinal distance between each of the nozzles for example, the longitudinal distance between nozzle 40*c* and nozzle 40*d*. Due to the level of twist of the thread in conjunction with the adjusted longitudinal distance d3 between the at least two nozzles 40*a* and 40*b*, it is possible to fully cover the outer surface area, i.e. outer perimeter of the thread 20. This makes the treatment unit 30 much less complex than nozzles arranged at different radial positions around the thread 20.

Figure 7:
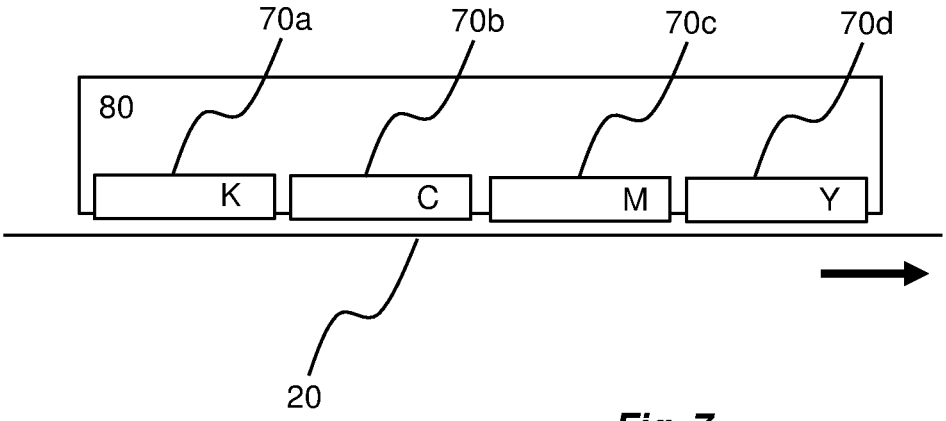
FIG. 7 shows a treatment unit according to an embodiment.

In an embodiment each nozzle dispenses a coating substance having a color according to the CMYK colour model, where the primary colors are Cyan, Magenta, Yellow, and Black. It may thus be possible to dispense a wide variety of colors onto the thread by activating nozzles such that the total coloring substance will be a mix of the coloring substances dispensed by the nozzles. In FIG. 7 an embodiment is shown wherein a nozzle head 80 is provided with multiple nozzle arrays 70*a-d*. Each nozzle array 70*a-d* may for example be an inkjet nozzle array, comprising thousands of nozzles. As an example, each nozzle array 70*a-d* may be associated with a single color, illustrated according to the CMYK standard. However, other coloring models may be used as well. It may also be possible to arrange the nozzle arrays 70*a-d* as separate units within the treatment unit 30.

In another embodiment, each nozzle dispenses a coating substance having a color comprising a mix of two or more primary colors of the CMYK color model.

In an embodiment, each nozzle is arranged within a nozzle plate (not illustrated), e.g. a flat nozzle plate, extending in a longitudinal direction in relation to the thread.

From the above, it should be recognized that based on the level of twist of the thread, and the ability to either adjust the longitudinal distances between each of the nozzles or to identify any nozzles for activation based on this longitudinal distance, it is possible to optimize the dispensing pattern formed by the included nozzles such that the best possible and most desired thread coating quality is achieved.

Although the present invention has been described above with reference to specific embodiments, it is not intended to be limited to the specific form set forth herein.

Rather, the invention is limited only by the accompanying claims.

In the claims, the term "comprises/comprising" does not exclude the presence of other elements or steps. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second" etc do not preclude a plurality. Reference signs in the claims are provided merely as a clarifying example and shall not be construed as limiting the scope of the claims in any way.

What is claimed is:

1. A system for in-line treatment of thread for use with a thread consuming device, comprising:

a treatment unit having a plurality of nozzles arranged at different positions relative the thread, said thread being in motion in use, each nozzle being configured to dispense one or more coating substances onto the thread when activated; and a control unit configured to set an activation timing of at least two of the nozzles such that each nozzle is configured to dispense the coating substance at different circumferential positions of the thread when the thread twists along its longitudinal axis, wherein the activation timing of the at least two nozzles is set at least based on thread speed and on the twist per length unit of the thread.

2. The system according to claim 1, wherein the control unit is configured to:

calculate a required longitudinal distance between the nozzles to be activated for allowing dispensing the coating substance on specific unique circumferential positions of the thread, and identify the nozzles of the treatment unit to be activated based on the known longitudinal distance between the nozzles and the required longitudinal distance.

3. The system according to claim 2, wherein the control unit is configured to calculate the longitudinal distance based on the twist of the thread.

4. The system according to claim 3, wherein the control unit is configured to set the longitudinal distance based on a forward feeding speed of the thread in conjunction with the twist of the thread or on a set activation timing of the nozzles.

5. The system according to claim 1, wherein the control unit is configured to set a longitudinal distance between the nozzles to be activated, wherein the longitudinal distance is set by longitudinally moving at least one of the nozzles such that said at least one nozzle can dispense the coating substance on a desired unique circumferential position of the thread.

6. The system according to claim 1, wherein the control unit is configured to set a longitudinal distance between a first position at which a dispensed droplet from a first nozzle is assumed to hit the thread and a second position at which a subsequently dispensed droplet from a second nozzle is assumed to hit the thread, and wherein the system further comprises means for changing the travel path of dispensed droplets in accordance with the longitudinal distance.

7. The system according to claim 1, wherein the nozzles are arranged in a common plane.

8. The system according to claim 1, wherein the control unit is further configured to set the longitudinal distance based on the twist per length unit of the thread, in accordance with $20\pi/\omega \geq d2$, d3, d4>0.

9. The system according to claim 1, wherein the at least two nozzles to be activated are provided on a common nozzle array.

10. The system according to claim 9, wherein the treatment unit comprises multiple nozzle arrays, and wherein a specific nozzle array is assigned with a specific coating substance.

11. The system according to claim 10, wherein one or more nozzle arrays are arranged in a common nozzle head.

12. The system according to claim 1, wherein the nozzles are inkjet nozzles.

13. The system according to claim 1, wherein the coating substance is a coloring substance.

14. The system according to claim 1, wherein the control unit is further configured to set the longitudinal distance based on the level of wetting of the thread.

15. The system according to claim 1, wherein the control unit is further configured to set the longitudinal distance based on a pre-set coating effect.

16. The system according to claim 15, wherein said pre-set coating effect is selected from the group comprising homogeneous colouring pattern, one-side-only colouring pattern, random coloring pattern, or helical coloring pattern.

17. A thread consuming device, comprising a thread consuming unit and a system according to claim 1.

18. The thread consuming device according to claim 17, wherein the thread consuming unit is an embroidery unit, a sewing unit, a knitting unit, or a weaving unit.

19. A method for in-line treatment of thread, comprising:

providing a treatment unit having a plurality of nozzles arranged at different longitudinal positions along the thread, each nozzle being configured to dispense a coating substance onto the thread when activated; and providing a control unit configured to set an activation timing of at least two of the nozzles such that each nozzles is configured to dispense the coating substance at different circumferential positions of the thread when the thread twists along its longitudinal axis, wherein the activation time of the at least two nozzles is set at least based on thread speed and on the twist per length unit of the thread.

* * * * *